US005326419A

United States Patent [19]

Boriani et al.

[11] Patent Number: 5,326,419

[45] Date of Patent: Jul. 5, 1994

[54] DEVICE FOR SPLICING STRIPS OF LIMITED TRANSVERSE DIMENSIONS AUTOMATICALLY

[75] Inventors: Silvano Boriani; Eros Stivani; Antonio Gamberini, all of Bologna, Italy

[73] Assignee: G.D. S.p.P., Bologna, Italy

[21] Appl. No.: 961,334

[22] Filed: Oct. 15, 1992

[30] Foreign Application Priority Data

Oct. 16, 1991 [IT] Italy ..... B091A000372

[51] Int. Cl.[5] ..... B65H 19/00; B65H 26/00

[52] U.S. Cl. ..... 156/361; 156/504; 156/506; 156/509; 156/543; 156/547

[58] Field of Search ..... 156/361, 502, 504, 505, 156/506, 509, 543, 547, 549; 242/75.45

[56] References Cited

U.S. PATENT DOCUMENTS

| | | | |
|---|---|---|---|
| 2,613,042 | 10/1952 | Dice, Jr. | 156/361 |
| 2,752,984 | 7/1956 | Casey | 156/361 |
| 3,505,148 | 4/1970 | Komer | 156/361 |
| 3,516,617 | 6/1970 | Haner et al. | 156/361 |
| 4,561,924 | 12/1985 | Hope et al. | 156/361 |
| 4,980,011 | 12/1990 | Gruber et al. | 156/361 |
| 5,039,374 | 8/1991 | Winter | 156/361 |
| 5,045,134 | 9/1991 | Schenker et al. | 156/361 |
| 5,064,488 | 11/1991 | Dickey | 156/361 |
| 5,203,935 | 4/1993 | May et al. | 156/361 |

*Primary Examiner*—David A. Simmons
*Assistant Examiner*—William J. Matney, Jr.
*Attorney, Agent, or Firm*—Cushman, Darby & Cushman

[57] ABSTRACT

Intended typically for slender tear strips, the automatic splicer comprises at least two supply reels wound with respective strips, the one in use and the other a replacement, set in rotation singly or together by a common drive, and feed wheels with peripheral grooves positioned with axes normal to the axes of the reels, by which the two strips are directed into a splicing station where the trailing end of the strip uncoiling from the reel in use is joined to the leading end of the strip uncoiled from the replacement reel; the splice is effected by means of a positioning and restraining component and a reference and reaction component stationed on either side of the strip in use, which can be drawn together until the ends of the strips are fully in contact, with the leading end of the replacement strip positioned and restrained in a longitudinal groove afforded by the relative component. The ends of the strips are trimmed automatically by separate cutters.

13 Claims, 3 Drawing Sheets

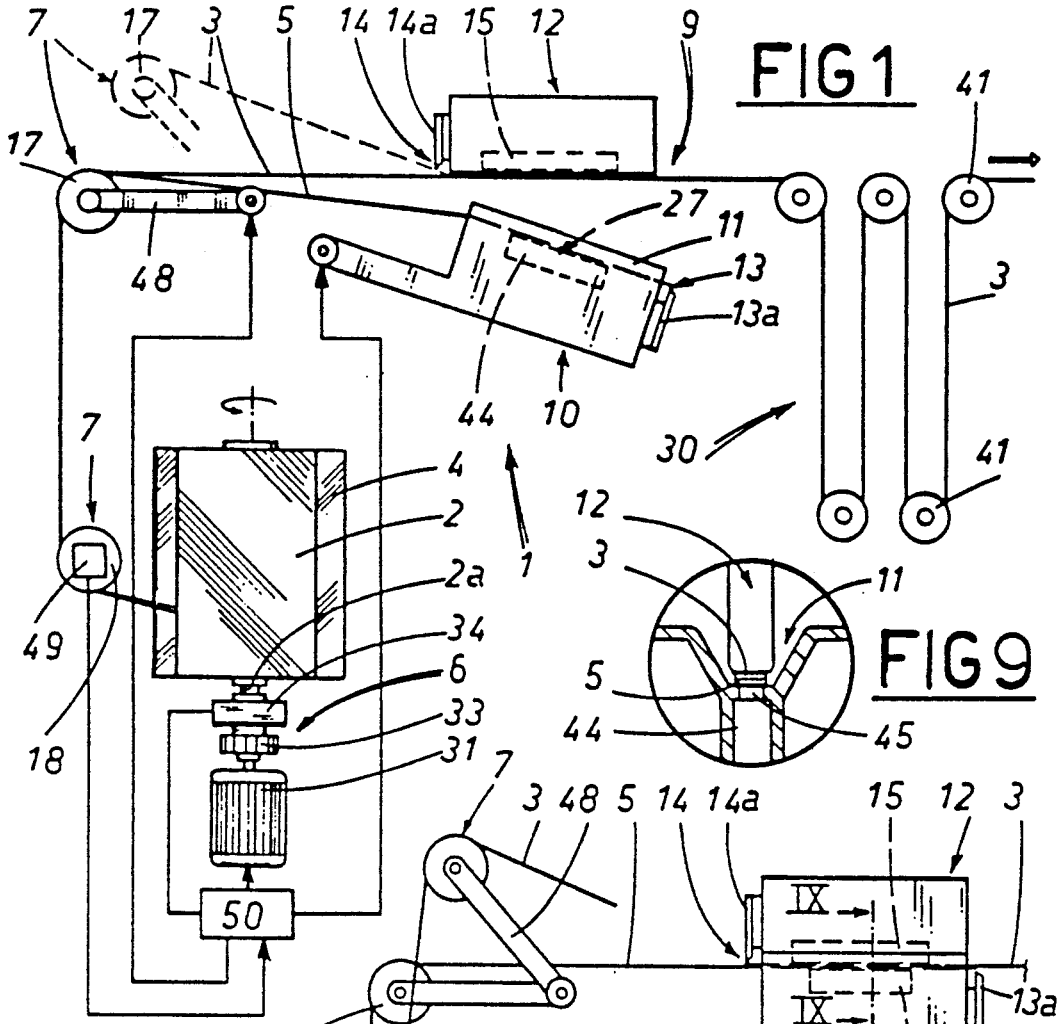
FIG1
7
17
3
5
14
14a
15
12
9
41
27
11
13
13a
48
44
10
30
4
2
2a
34
6
33
31
49
18
1
50
FIG9
12
3
11
5
44
45
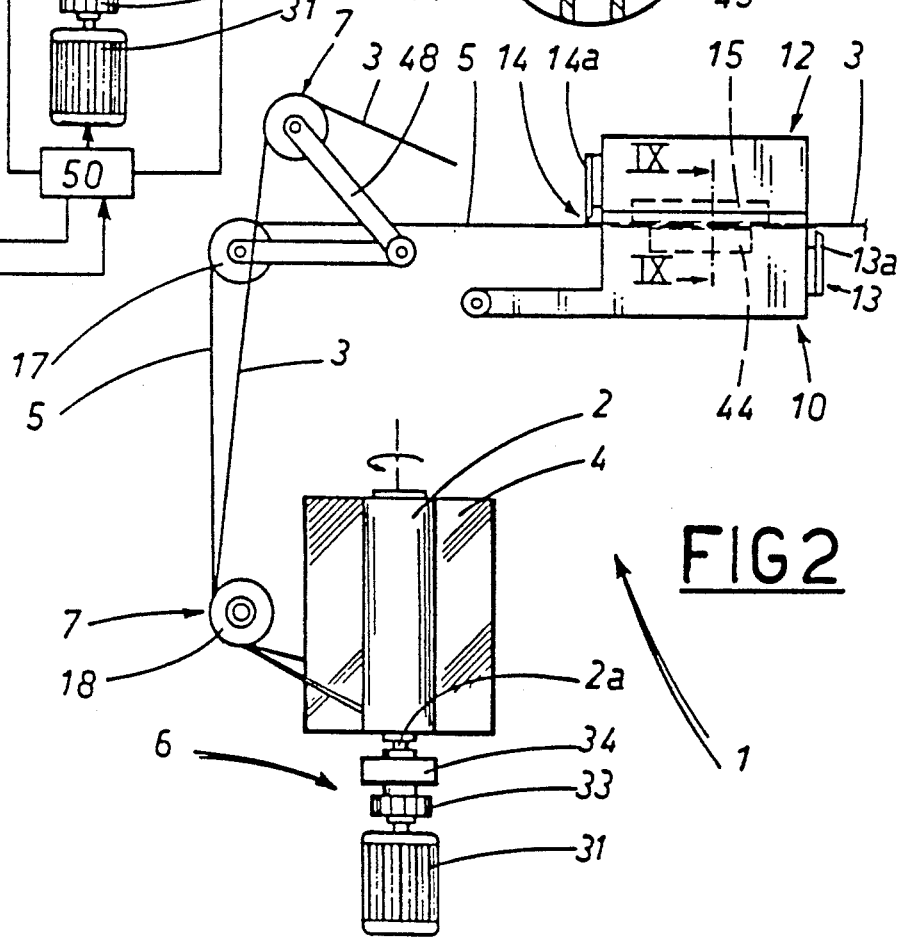
FIG2
7
3
48
5
14
14a
15
12
IX
13a
13
17
44
10
2
4
18
2a
6
34
33
31
1

47
26
3
5
45
44
43
42
29
28
26
37
11
25
27
42
25
46
13a
5'
37
28
26
12
47
VI
28
3
5
10
VI
27'
45
11
51
5
11
25
43
44
45
25
44
27
43
46

DEVICE FOR SPLICING STRIPS OF LIMITED TRANSVERSE DIMENSIONS AUTOMATICALLY

BACKGROUND OF THE INVENTION

The present invention relates to a device by which strips of limited transverse dimensions are spliced automatically.

Conventionally, narrow tear strips of the type in question are fixed to the inner face of wrappers enveloping packs of cigarettes, candy and similar products, in cases where it is wished to establish a predetermined and clearly defined breaking line in the wrapper.

Such strips are supplied in bulk reels which hold a notable quantity of material, precisely by reason of the limited dimensions of the strip itself. When utilizing a traditional wrapping machine typified by operation at relatively low speed, therefore, it happens that the duration of the reel of tear strip is long compared to that of the roll of wrapping material, and the frequency with which replacement becomes necessary is decidedly low compared to the frequency with which the rolls of wrapping material need to be replaced. With the need for changeover occurring so infrequently, it would be considered acceptable to stop the wrapping machine for a time sufficient to replace the reel of strip material by hand, as this would not significantly affect either the overall operating speed of the machine, or, by extension, its overall efficiency.

Successive increases in the operating speeds of wrapping machines have been accompanied by a need to cut this down time, given that any pause, even of a few seconds, can detract significantly from the overall efficiency of the machine.

It will be noted, in fact, that variations in the overall efficiency of such machines become more evident as the operating speed increases. In addition, it becomes increasingly difficult for an operator to change reels in a very short time without errors occurring, especially considering the precision required and the exiguous transverse dimensions of such strips, of which the width may vary between 1, 2 and 6 mm, and is typically 2 mm or thereabouts.

The object of the present invention is to provide a device by which strips of the type in question can be spliced automatically and with a high degree of precision.

SUMMARY OF THE INVENTION

The stated object is realized in a device according to the present invention.

The device in question, by which strips of limited transverse dimensions are spliced automatically, comprises a first or operating supply reel of the strip material for supplying to a user machine, at least one standby reel of strip material providing a replacement strip ready to be supplied to the user machine on depletion of the reel of strip in use, drive means by which the reel in use and the change reel are rotated independently about their respective axes, and rolling feed means or a feed roller positioned with respective axes normal to the axes of the reels and serving to direct the uncoiling strips toward splicing means by which the trailing end of the strip in use and the leading end of the replacement strip are joined together.

Advantageously, the splicing means comprises two components disposed and operating on opposite sides of the strip in use and capable of movement toward and away from one another, one providing a groove in which the replacement strip is positioned and restrained, the other providing a reference and reaction surface facing the component opposite and insertable into the relative groove to the point where the strip in use and the replacement strip are fully in contact.

The leading end of the replacement strip and the trailing end of the strip in use are trimmed by respective cutting means, and the device will also comprise monitoring and control means designed to pilot the operation at least of the drive means and the splicing means. In addition sensing means are designed to verify the state of depletion of the reel in use and relay a reel change signal to the monitoring and control means.

BRIEF DESCRIPTION OF THE DRAWINGS

The invention will now be described in detail, by way of example, with the aid of the accompanying drawings, in which:

FIG. 1 is a side elevation of the splicing device according to the invention, showing a supply reel of strip material partially uncoiled;

FIG. 2 is a side elevation of the device of FIG. 1, showing a supply reel of strip material completely uncoiled and the relative strip in the process of being spliced with strip uncoiled from a change reel;

FIG. 9 is the central part of the section through IX—IX in FIG. 2.

DESCRIPTION OF THE PREFERRED EMBODIMENTS

Figures 3, 4, 8:
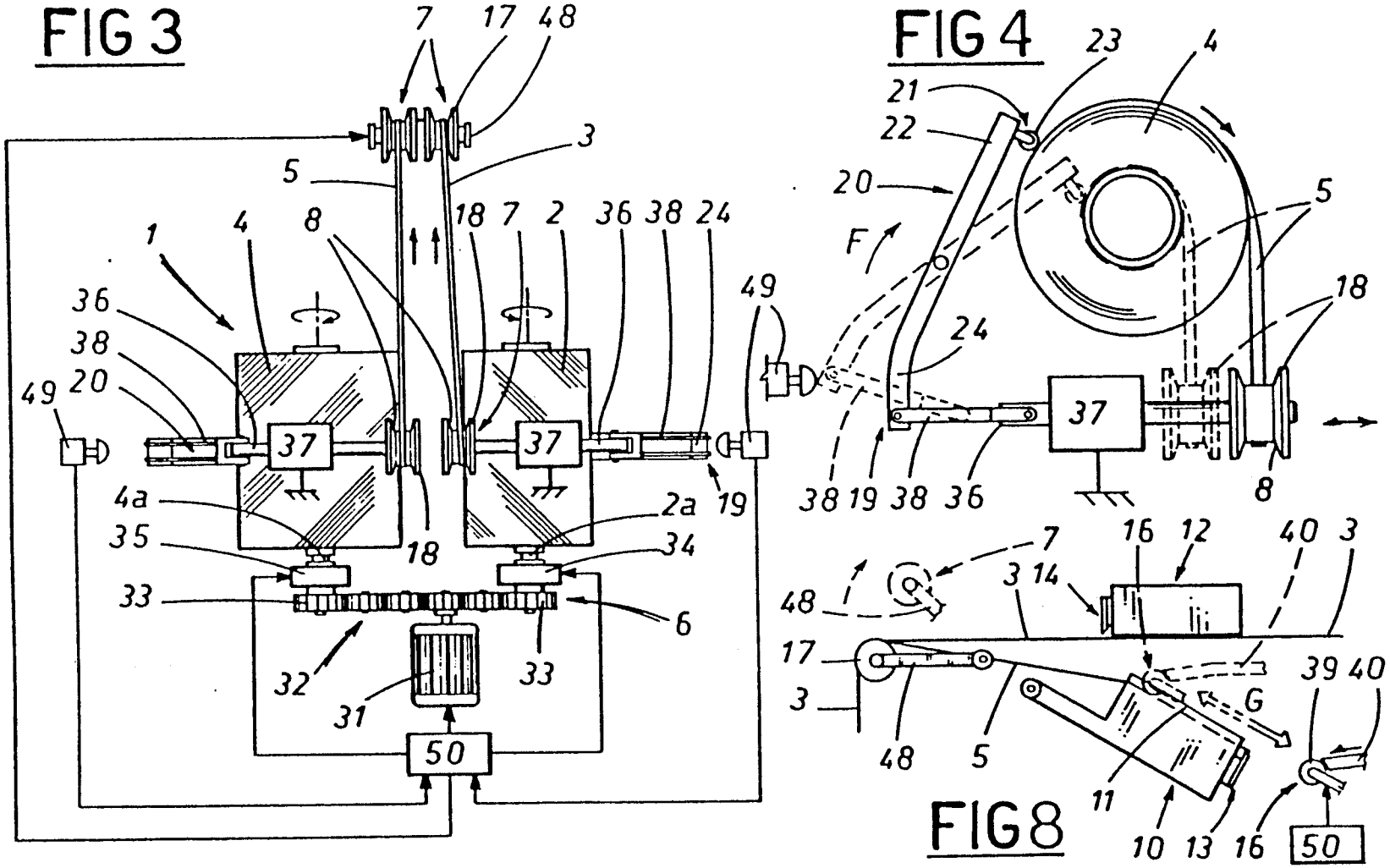
FIG. 3 is a front elevation of the device according to the invention, viewed in the configuration of FIG. 1 and with certain parts omitted.
FIG. 4 illustrates a detail of the device according to the invention, viewed in plan and on a different scale.
FIG. 8 shows an alternative embodiment of a detail of FIGS. 1 to 4, viewed in side elevation.

Referring to the accompanying drawings, numeral 1 denotes a device according to the present invention, in its entirety, for splicing strip material of limited transverse dimensions automatically. Such a device comprises at least two reels 2 and 4 supplying two respective strips 3 and 5 of limited transverse dimensions (See FIG. 1), rolling feed means 7 disposed with axes perpendicular to the axes of the reels 2 and 4 and affording circumferential grooves 8 (See FIG. 3) to receive and guide the two strips 3 and 5, means 9 by which to splice the strips 3 and 5, and means 13 and 14 by which to cut the leading end of the replacement strip and the trailing end of the depleted strip, respectively.

The reels 2 and 4, consisting each in a continuous strip 3 and 5 coiled helically onto a central core, are supported with axes vertically disposed and parallel; one reel 2 is shown in a configuration of use as an operating reel, with the relative strip 3 being fed to a user machine (not illustrated), whilst the remaining reel 4 is shown in a standby configuration with the relative strip 5 positioned in readiness to replace the strip 3 currently being supplied to the machine from the first reel 2.

Accordingly, the reels 2 and 4 are identified throughout as the reel in use 2 and the change reel 4; the configurations will be reversed following a splice, clearly enough, though this does not materially affect the operation of the device according to the invention.

The reels 2 and 4 are set in rotation about their respective axes by drive means, denoted 6, capable of transmitting motion to each axis independently. Such drive means 6 might consist, for example, in a single motor 31 connected mechanically to a train of gears 32 of which two members 33 are keyed to the shafts 2*a* and 4*a* of the reels 2 and 4 by way of respective couplings 34 and 35, electrodynamic for instance, interlocked to monitoring and control means 50, which can be disengaged selectively in such a way as to permit of driving either one of the reels 2 or 4 by itself. The motor 31 will be a variable speed type, to the end of maintaining a steady uncoiling rate of the strip 3 or 5.

The rolling feed means or roller 7 serving each reel 2 and 4 consist in two freely revolving wheels 17 and 18 turning about respective horizontal axes. The wheel denoted 18 is positioned at a height corresponding substantially to the middle area of the relative reel 2 or 4 and capable of axial movement, brought about by respective actuator means 19, such as will ensure that the relative strip 3 or 5 maintains a trajectory substantially perpendicular to the axis of the wheel 18 as the reel uncoils, and does not become unseated from the circumferential groove 8; the actuator means 19 are interlocked to sensing means 21 serving to monitor the depletion of the respective reel 2 or 4.

As shown in FIG. 4, each wheel denoted 18 is mounted freely to one end of a spindle 36, which in turn is slidable along its own axis, supported by a base or frame 37 serving also to support the device 1 in its entirety. The remaining end of the spindle 36 is connected mechanically, by way of a rod 38, to one end of one arm 24 of a rocking lever 20 mounted pivotably to the frame 37 at an intermediate point along its length and constituting the actuator means 19. The free end of the remaining arm 22 of the rocking lever 20 carries a feeler 23 embodied as a freely revolving roller, which constitutes a part of the aforementioned sensing means 21. Also associated with the rocking lever 20 will be spring means (not shown) serving to ensure rotation in the direction of the arrow denoted F and thus maintain the feeler 23 in permanent contact with the strip 3 or 5 of the respective reel 2 or 4. On reaching a travel limit that coincides with final depletion of the reel in use 2, the linked arm 24 of the rocking lever 20 activates respective sensing means 49 of which the output is connected to the monitoring and control means 50 (see FIGS. 1 and 3).

The remaining wheel 17 occupies a position higher than that of the relative axially slidable wheel 18 and substantially in alignment with the splicing means 9, as discernible from FIGS. 1 and 3. Each wheel 17 is carried by a respective arm 48 hinged about an axis disposed parallel to the axis of rotation of the wheel 17; the arm 48 is capable of movement, produced by actuator means (not shown) interlocked to the monitoring and control means 50 as illustrated schematically in FIG. 1, between two limit positions in which the wheel 17 is suspended at two different heights: at the lower height, the wheel 17 is positioned substantially in alignment with the splicing means 9 (see FIGS. 1 and 2) for a reason that will subsequently be made clear.

Splicing means 9 comprise at least one component 10 of which the function is to position and restrain the leading end of the replacement strip 5, and a complementary reference and reaction component 12. The positioning and restraining component 10 and the reference and reaction component 12 are placed on opposite sides of the strip 3 in use and capable of being spread apart and drawn together, in the latter instance, to the extent of establishing a limit configuration in which the two strips 3 and 5 are in complete mutual contact. More exactly, the reference and reaction component 12 is stationary, rigidly associated with the frame 37, whilst the positioning and restraining component 10 is capable of movement toward and away from the stationary component; here too, such movement is produced by actuator means (not illustrated) interlocked to the monitoring and control means 50 (see FIG. 1). The positioning and restraining component 10 affords a longitudinal groove 11 proportioned to receive and guide the replacement strip 5, and is equipped with suction means 27 operating along the bottom of the groove 11 and designed to maintain the strip 5 in contact with this same bottom surface.

Figures 5, 6, 7:
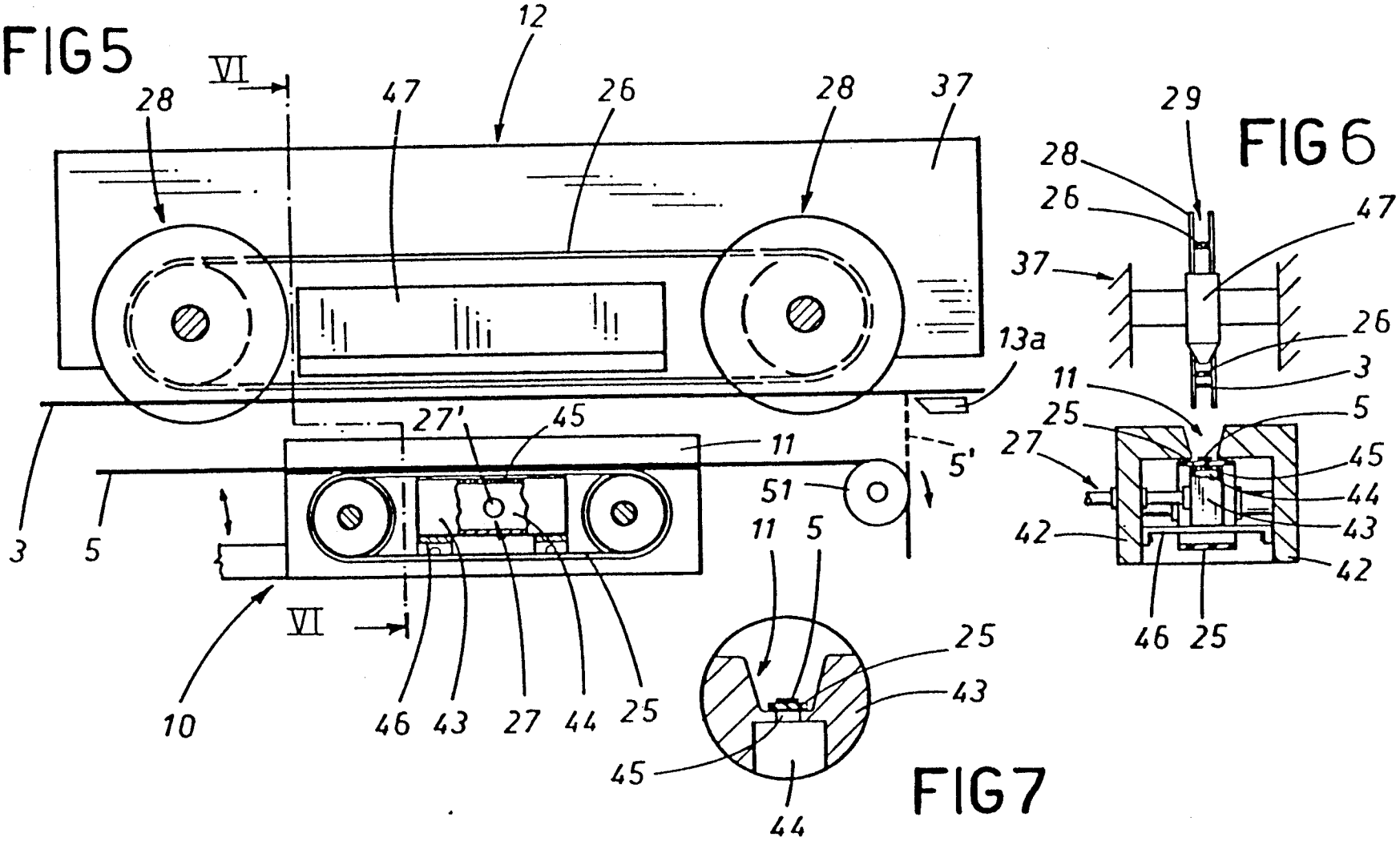
FIG. 5 shows an alternative embodiment of a detail of FIGS. 1 to 4, viewed in side elevation and on a different scale, and with certain parts omitted better to reveal others.
FIG. 6 is the section through VI—VI in FIG. 5.
FIG. 7 shows an alternative embodiment of a detail of FIG. 6, viewed on a different scale and in cross section.

As shown in FIG. 9, the positioning and restraining component 10 incorporates a chamber 44 positioned beneath the groove 11 and communicating with the bottom surface by way of a plurality of holes 45. The chamber 44 is connected by a pipeline 27' to a source of negative pressure not illustrated. The reference and reaction component 12 is of shape such as to allow its insertion into the groove 11 of the positioning and restraining component 10, as indicated in FIG. 6, albeit this particular drawing illustrates a different type of embodiment.

The splicing means 9 also comprise means by which ultimately to effect a union of the strips 3 and 5, of a type that will depend on the nature of the actual strip material utilized.

In the event that the strips 3 and 5 are of a heat sealable material, such means will comprise heating means 15 positioned internally of the reference and reaction component 12, by which the strips 3 and 5 are fused together as the two components 10 and 12 are drawn into mutual contact. If on the other hand the strips 3 and 5 are not heat sealable, or are coated with paints or lacquers so as to render a direct heat seal impracticable, and are devoid of any adhesive coating, use might be made of adhesive dispensing means 16, as illustrated schematically in FIG. 8. In this particular example, such dispensing means 16 are embodied as a roller 39 capable of movement, again produced by actuator means (not illustrated) interlocked to the monitoring and control means 50, in a direction G parallel to the bottom surface of the groove 11 of the positioning and restraining component 10 when this same component is distanced from the reference and reaction component 12. The dispensing roller 39 operates in conjunction with relative means 40 by which its peripheral surface of revolution is coated with an adhesive, or with double-sided stickers.

The device 1 can operate either continuously or intermittently, while maintaining the supply of the strip 3 in use to the wrapping machine at a steady rate of feed in each case; in the latter instance, a magazine or flow compensating facility 30 will be incorporated. The magazine 30 shown is conventional in embodiment, consisting in a plurality of freely revolving pulleys 41 with circumferential grooves by which the strip 3 is guided;

in operation, the pulleys are able to draw together when the strip 3 is restrained on the infeed side, and to spread apart when the strip 3 advances at a steady rate. In the embodiment of FIGS. 5 and 6, where for the sake of clarity the two components 10 and 12 of the splicing means are shown spread apart, though when performing a splice the two would be drawn together with the strips 3 and 5 lapping in mutual contact, both the positioning and restraining component 10 and the reference and reaction component 12 carry a relative conveyor belt 25 and 26 placed to enter into contact with the replacement strip 5 and with the strip 3 in use, respectively.

In FIG. 6, the conveyor belt denoted 25 constitutes the bottom surface of the groove 11 afforded by the positioning and restraining component 10, which is embodied in two half-sections 42 supported by the frame 37 and spaced apart one from the other by a distance corresponding to the width of the groove.

The half-sections 42 in turn support a housing 43, located within the compass of the conveyor belt 25, along which the top branch of the belt 25 is made to ride. The internal cavity or chamber 44 afforded by the housing 43 communicates on the one hand with suction means 27 by way of the pipeline 27', and on the other with the top branch of the belt 25 by way of holes 45 in the face uppermost; in addition, the belt 25 is embodied in a material permeable by air. With this arrangement, a force of attraction can be generated by suction to the end of maintaining the replacement strip 5 in contact with the top branch of the conveyor belt 25. Both the belt 25 and the housing 43 are accommodated within the chamber 46 established by the half-sections 42.

In operation, the conveyor belts 25 and 26 will be interlocked to the monitoring and control means 50.

In the embodiment of FIG. 7, the half-sections 42 are joined one to the other, thereby establishing a groove 11 of which the bottom surface is offered to the running conveyor belt 25. Again, the bottom of the groove 11 affords holes 45 communicating on the lower side of the half-sections 42 with the cavity or chamber 44 of the housing 43, and the conveyor belt 25 is fashioned in a material previous to air, in such a way as to function in a manner identical to that of the embodiment illustrated in FIG. 6.

The remaining conveyor belt 26 is looped around two pulleys 28 affording circumferential grooves 29 in which to accommodate and guide both the belt 26 and the strip 3 in use. The distance between centres of the pulleys 28 is greater than the length of the positioning and restraining component 10, and the belt 26 operates in conjunction with a stationary reaction element 47 located between the branches, insertable in the groove 11 and functioning as a reference against which the bottom branch of the belt 26 locates when the components 10 and 12 of the splicing means are brought together.

The cutting means 13 and 14 are associated with the two components 10 and 12 of the splicing means, and consist in a pair of blades **13*a* and 14*a* secured to the components 10 and 12 in positions respectively forward and back, considered in relation to the feed direction of the strips 3 and 5. The position of the cutting means denoted 14 will be such that, when the wheel 17 of the feed means is raised to its upper limit position, the relative strip 3 is brought into contact with the blade 14*a* and parted. FIG. 5 illustrates a power driven wheel 51 occupying a position beyond the lower conveyor belt 25, in relation to the feed direction, and substantially at the same height, over which the leading end of the replacement strip 5 is positioned and/or wound. The rotation of the wheel 51 is synchronized with the movement of the belt 25, so as to ensure that the replacement strip 5 will be fed forward at the correct rate when spliced with the strip 3 in use. In the example of FIG. 5, the forward blade 13*a* is disposed parallel with and below the strip 3 in use at a point beyond the lower belt 25**.

Observing the drawings, in particular FIGS. 1, 3 and 8, it will be seen that the circuit for sensing, monitoring and controlling the main functions of the device 1 is relatively simple, though naturally such a circuit will serve to monitor and control additional functions not expressly described here.

Referring to FIGS. 1–4, the strip 3 in use uncoils from the relative reel 2, passing over the freely revolving feed wheels 17 and 18 and thence between the components 10 and 12 of the splicing means 9, riding against the underside of the reference and reaction component 12.

The feeler 23 stays permanently in contact with the peripheral revolving surface of the reel 2 in use, as a result of which the relative wheel 18 shifts axially to keep the strip 3 running perpendicular to the axis of rotation of the wheel 18, as shown in FIG. 4. In the meantime, the operator of the user machine will have loaded a change reel 4 and drawn out a length of the replacement strip 5 sufficient to pass around the relative feed wheels 17 and 18, whereupon the leading end is offered to the bottom of the groove 11 provided by the positioning and restraining component 10, which may or may not be of the type equipped with a conveyor belt 25 (see FIGS. 5 to 8). Having activated the suction means 27 so as to restrain the replacement strip 5 by force of attraction against the bottom of the groove 11 or against the top branch of the conveyor belt 25, the operator pulls the leading end of the strip 5 downwards against the forward blade **13*a*, effecting a first cut. The moment that the sensing means 49 are activated by the lever arm 24, the monitoring and control means 50 will automatically pilot the entire sequence of steps making up the operation whereby the strips 3 an 5 are spliced, now to be described. First, the positioning and restraining component 10 is drawn up and toward the reference and reaction component 12, to the point at which the strips 3 and 5 are fully lapped. The instant that the two strips 3 and 5 are gripped between the components 10 and 12, the feed wheel 17 carrying the strip 3 in use will be raised, such that the trailing end of the strip is lifted against the back blade 14*a* and cut. At the same time, in the event that the strips 3 and 5 are of heat sealable material, the heating means 15 will be activated to fuse the two ends together. Thereafter, the suction means 27 having been deactivated, the positioning and restraining component 10 is distanced from the reference and reaction component 12 and the user machine begins to receive the replacement strip 5, which now becomes the strip 3 in use. The reel 2 previously in use, now depleted, is replaced with a further reel 4** and the operator prepares for the next changeover.

In the event that the strips 3 and 5 are not of heat sealable material, the steps of arranging the leading end of the replacement strip 5 internally of the groove 11 of the positioning and restraining component 10 and effecting the first cut against the relative blade **13*a*** are followed by activation of the adhesive dispensing means 16, through the agency of the monitoring and control means 50; at this juncture, accordingly, with the strip 5 held by the suction means 27 against the bottom of the groove 11 or against the top branch of the conveyor belt 25, a film of adhesive material or a double sided sticker is applied. Whilst the term "adhesive dispensing" does not perfectly describe means 16 of the type used to apply double sided stickers, the essential purpose of such means remains the same, i.e. to provide one side of the replacement strip 5 with an adhesive coating. In the event that the strips 3 and 5 are previously gummed on one side, neither heating means 15 nor adhesive dispensing means 16 will be utilized.

Referring now to FIGS. 5 and 6 and the embodiment of the device having the conveyor belts 25 and 26, it will be seen that the belts are not drawn to scale, and that the components 10 and 12 of the splicing means are shown out of the correct positions better to illustrate other features of the arrangement. Here, the leading end of the replacement strip 5 is passed over and/or around the power driven wheel 51 and, following activation of the components 10 and 12, cut automatically by the relative blade 13*a* as it is fed forward together with the strip 3 in use; in effect, the leading end of the strip 5 is held taut by the live wheel 51 while advancing toward the blade 13*a* (see FIG. 5, where the leading end of the replacement strip 5 is denoted 5' and shown in phantom line). At the moment of changing reels, the lower conveyor belt 25 and the live wheel 51 are set in motion and accelerated such that when the leading end of the replacement strip 5 enters into contact with the strip 3 currently in use, the two strips 5 and 3 will advance at the same rate of feed. It is important in this embodiment that the suction means 27 are deactivated only when the one component 10 is distanced from the other 12.

What is claimed is:

1. A device for automatically splicing and supplying thin strips of material to a machine, said device comprising:

an operating reel rotatable about a first axis and adapted to supply the strip material to said machine;

at least one standby reel rotatable about a second axis parallel with said first axis and adapted to supply the strip material to said machine upon depletion of the strip material from said operating reel;

means for rotatably driving said operating reel and said at least one standby reel selectively about said first and second axes respectively;

means for splicing a trailing end of said strip material from said operating reel to a leading end of said strip material from said at least one standby reel upon depletion of the strip material from said operating reel;

means for controlling the operation of at least said driving means and said splicing means;

sensing means for determining an amount of depletion of said operating reel and for generating a signal to said controlling means so that said splicing and driving means enable said at least one standby reel to supply said strip material to said machine when said operating reel is depleted; and at least one feed roller for guiding the strip material as said strip material is supplied by the reels, said at least one feed roller being rotatable about a third axis, which third axis is generally perpendicular to said first and second axes, said at least one feed roller being operably connected to said sensing means and movable along said third axis so as to generally align itself with an outer periphery of said strip material on one of said reels as said sensing means detects the depletion of strip material therefrom.

2. A device as claimed in claim 1, wherein said splicing means comprises first and second components disposed on opposite sides of a portion of said strip material and movable towards one another, said first component providing a groove in which said strip material from the standby reel may be positioned and restrained, said second component providing a reference and reaction surface facing said first component, said second component being insertable into said groove and cooperable with said first component to maintain respective portions of strip material from said operating and standby reels in mutual contact with one another.

3. A device as in claim 1, wherein said strip material comprises heat sealable material, and further comprising heating means associated with said splicing means.

4. A device as in claim 1, further comprising dispensing means for applying an adhesive to said strip material.

5. A device as in claim 4, wherein said applying means is capable of applying a double sided sticker to said strip material.

6. A device as in claim 2, further comprising first cutting means associated with the first component of the splicing means and second cutting means associated with the second component, and wherein one of said at least one feed roller is capable of movement between a passive position in which the strip material is able to remain distanced from the second cutting means, and an active position in which the strip material contacts the second cutting means.

7. A device as in claim 1, wherein said at least one feed roller comprises two feed rollers operatively associated with each of said reels, and wherein one of said two rollers associated with each of said reels is of capable of movement along its own axis so as to maintain the trajectory of the strip material substantially perpendicular to the axis along which the movement of the rolling feed means occurs.

8. A device as in claim 1, further comprising actuator means including two arms of which one carries said sensing means, and another which is linked mechanically to said at least one feed roller.

9. A device as in claim 2, wherein said slicing means further comprises:

first and second conveyor belts associated with the first and second components respectively, at least the first conveyor belt comprising a material permeable by air;

suction means for holding the strip material from said standby reel against the permeable material of said first conveyor belt; and means for driving said first belt at a tangential velocity equal to a velocity at which the strip travels as it is supplied by the operating reel so that the strip material of the standby reel can be set in motion and advanced at the same velocity as the strip material from the operating reel and so that the first and second components can bring the respective strips of material into mutual contact.

10. A device as in claim 1, wherein the reels are held still by the driving means while said splicing means splices said trailing end with said leading end, and further comprising a magazine for maintaining the continuity at which the strip material is provided to said user machine.

11. A device as in claimed in claim 8, wherein said sensing means carried by said one arm comprises a feeler which maintains contact with the outer periphery of said strip material on one of said reels.

12. A device as claimed in claim 11, wherein said splicing means includes cutting means for cutting the leading of said strip material of said standby reel and the trailing end of said strip material of said operating reel.

13. A device as claimed in claim 11, wherein said strip material has a width in the range between about 1–6 mm.

* * * * *

UNITED STATES PATENT AND TRADEMARK OFFICE

CERTIFICATE OF CORRECTION

PATENT NO. : 5,326,419

DATED : July 5, 1994

INVENTOR(S) : BORIANI et al.

It is certified that error appears in the above-indentified patent and that said Letters Patent is hereby corrected as shown below:

On the title page, item [73], change "G.D. S.p.P." to --G.D. S.p.A.--

Signed and Sealed this

Fifteenth Day of November, 1994

*Attest:*

Bruce Lehman

BRUCE LEHMAN

*Attesting Officer*

*Commissioner of Patents and Trademarks*